US009919530B2

(12) United States Patent
Mizushima et al.

(10) Patent No.: US 9,919,530 B2
(45) Date of Patent: Mar. 20, 2018

(54) PRINTING APPARATUS

(71) Applicant: SEIKO EPSON CORPORATION, Tokyo (JP)

(72) Inventors: Nobuyuki Mizushima, Shiojiri (JP); Satoshi Chiba, Suwa (JP); Yoshikazu Koike, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/354,786

(22) Filed: Nov. 17, 2016

(65) Prior Publication Data

US 2017/0151788 A1 Jun. 1, 2017

(30) Foreign Application Priority Data

Nov. 26, 2015 (JP) ..... 2015-230325

(51) Int. Cl.
*B41J 2/165* (2006.01)
*B41J 11/00* (2006.01)

(52) U.S. Cl.
CPC ..... *B41J 2/16535* (2013.01); *B41J 11/007* (2013.01)

(58) Field of Classification Search
None
See application file for complete search history.

(56) References Cited

U.S. PATENT DOCUMENTS

2014/0284177 A1* 9/2014 Chiba ..... B41J 11/007 198/497

FOREIGN PATENT DOCUMENTS

JP 2008-116539 5/2008
JP 2014-184994 10/2014

* cited by examiner

*Primary Examiner* — Erica Lin
(74) *Attorney, Agent, or Firm* — Workman Nydegger

(57) ABSTRACT

A printing apparatus includes a transport belt, a print head, a static eliminating section, and a wiping section. The transport belt electrostatically adsorbs a medium on an outer surface thereof and transports the medium in a transport direction.

5 Claims, 5 Drawing Sheets

PRINTING APPARATUS

BACKGROUND

1. Technical Field

The present invention relates to a printing apparatus that performs printing onto a medium that is electrostatically adsorbed onto a transport belt.

2. Related Art

A known printing apparatus includes a printing apparatus provided with a transport belt that transports a medium, such as paper, which is electrostatically adsorbed onto the transport belt, and a printing section that performs printing by ejecting ink onto the medium transported by the transport belt. Such a printing apparatus may have a plurality of cleaning sections for cleaning the transport belt to which ink or paper powder has adhered (see, for example, JP-A-2014-184994).

More particularly, a printing apparatus of this type has a first cleaning section and a second cleaning section provided at different positions in the direction of rotation of the transport belt. After cleaning a transport belt at the first cleaning section, the printing apparatus cleans the transport belt at the second cleaning section, thereby removing adhering material to the transport belt.

Incidentally, in the above printing apparatus, having around the transport belt a static eliminating section that eliminates electric charge from a printing surface of a medium and an electrifying section that electrifies the transport belt can increase the adsorption force of the transport belt with respect to the medium. In this case, having a plurality of cleaning sections around the transport belt may increase complexity.

SUMMARY

An advantage of some aspects of the invention is that it provides a printing apparatus which can remove a foreign substance that has adhered to a transport belt while minimizing complexity around the transport belt transporting a medium.

Solutions to the above problem and their operations and advantages will be described below.

A printing apparatus according to an aspect of the invention includes an endless transport belt, a print head, a static eliminating section, and a wiping section. The endless transport belt electrostatically adsorbs a medium on an outer surface of the transport belt and rotates to transport the medium in a transport direction. The print head performs printing onto a printing surface of the medium electrostatically adsorbed onto the transport belt. The static eliminating section, which is disposed upstream from the print head in the transport direction, makes contact with the outer surface of the transport belt and the printing surface of the medium electrostatically adsorbed on the outer surface of the transport belt and eliminates electric charge from the printing surface of the medium. The wiping section, which is disposed at a side opposite the print head, as viewed from the static eliminating section in a direction of rotation of the transport belt, wipes the outer surface of the transport belt. The static eliminating section is longer than the wiping section in a width direction intersecting the transport direction.

According to the above configuration, eliminating electric charge from the printing surface of the medium by using the static eliminating section can increase the adsorption force of the transport belt with respect to the medium. The print head can thus perform printing onto the medium adsorbed onto the transport belt with stabilized positioning.

On the other hand, the wiping section removes foreign substances, hereinafter also referred to as adhering material, adhering to the outer surface of the transport belt while the medium is being transported or while printing is being performed. The static eliminating section, which is longer than the wiping section in the width direction, removes adhering material on the outer surface of the transport belt that have not been removed by the wiping section. That is, adhering material that the wiping section has not removed are removed by the static eliminating section sliding in contact with the outer surface of the transport belt rotating.

In this way, according to this configuration, two structures, the static eliminating section and the wiping section, used for wiping the outer surface of the transport belt can remove adhering material on the transport belt. Since one of the two structures that are used to wipe the outer surface of the transport belt is the static eliminating section that eliminates electric charge from the printing surface of the medium, this configuration can minimize complexity around the transport belt that transports the medium, compared to cases where a separate structure that is used to eliminate electric charge from the printing surface of the medium is provided in addition to two structures that are used to merely wipe the outer surface of the transport belt.

In the above printing apparatus, it is preferable that the static eliminating section have a brush that makes contact with the outer surface of the transport belt and the printing surface of the medium.

According to the above configuration, adhering material to the transport belt can be removed easily by the brush of the static eliminating section.

It is preferable that the above printing apparatus further include an electrifying section that electrifies the transport belt and that the electrifying section be provided between the wiping section and the static eliminating section in the direction of rotation of the transport belt.

According to the above configuration, the electrifying section electrifies the transport belt from which the adhering material have been removed by the wiping section; this can increase the adsorption force of the transport belt with respect to the medium.

In the above printing apparatus, it is preferable that the static eliminating section be equal to or longer than the print head in the width direction.

According to the above configuration, an area on the transport belt facing the print head is an area that has been cleaned by the static eliminating section. In other words, such a configuration reduces an area on the transport belt that has not been cleaned by the static eliminating section or the wiping section from facing the print head. Thus, adhering material to the transport belt neither make contact with the print head nor adhere to the print head. As a result, this configuration can suppress a reduction in the printing quality of the printing apparatus.

It is preferable that the above printing apparatus further include a first rotator and a second rotator that are provided at different positions in the transport direction, with the width direction being a direction of an axis of rotation. It is also preferable that the transport belt be looped over the first rotator and the second rotator and that the wiping section bias, toward an inner surface of the transport belt, the outer surface of the transport belt looped over the first rotator and the second rotator.

Slack on the transport belt looped over the first rotator and the second rotator may cause the transport belt to rotate irregularly, leading to a reduction in the transport accuracy of the medium. According to the above configuration, the outer surface of the transport belt looped over the first rotator and the second rotator is biased toward the inner surface of the transport belt; tension can be applied to the transport belt so as not to become loose. In this way, according to this configuration, the wiping section can avoid slack on the transport belt and a reduction in the transport accuracy of the medium.

It is preferable that the above printing apparatus further include a hold section that holds, in conjunction with the wiping section, the transport belt across the width by making contact with the inner surface of the transport belt when the wiping section is wiping the outer surface of the transport belt.

When the wiping section is wiping the outer surface of the transport belt, the transport belt may be displaced away from the wiping section. This displacement may cause a region on the transport belt not to be in contact with the wiping section. In this state, the outer surface of the transport belt cannot be wiped normally. In contrast, according to the above configuration, when the wiping section is wiping the outer surface of the transport belt, the hold section makes contact with the inner surface of the transport belt; the transport belt is held between the wiping section and the hold section. This configuration inhibits the transport belt from being displaced away from the wiping section. Thus, when the wiping section is wiping the transport belt, adhering material to the transport belt can be easily removed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the accompanying drawings. A printing apparatus according to this embodiment is an ink jet printer that forms text and images by ejecting ink onto a medium, such as paper.

Figure 1:
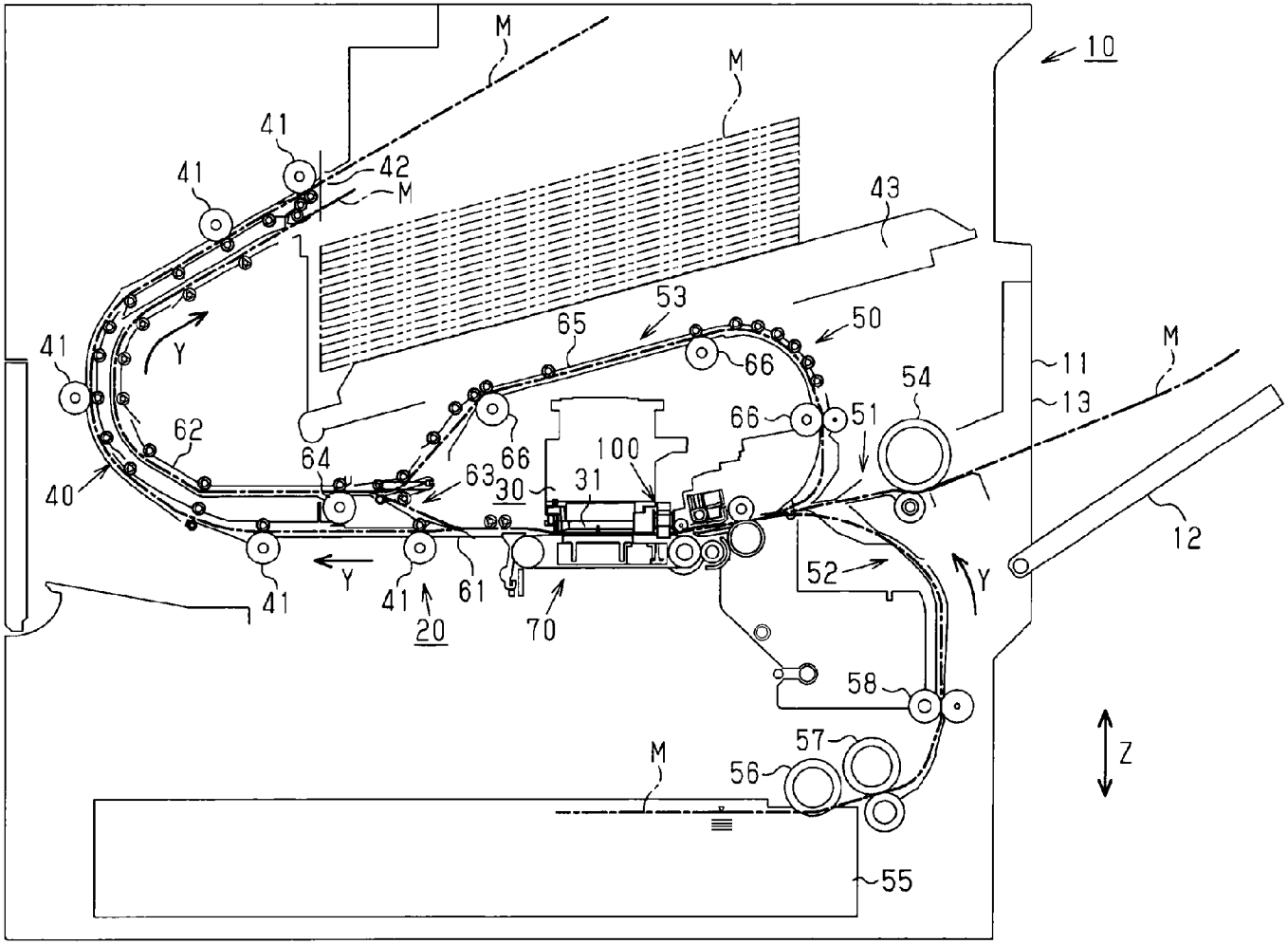
FIG. 1 is a side view illustrating the general structure of a printing apparatus according to one embodiment of the invention.

As illustrated in FIG. 1, a printing apparatus 10 in this embodiment has a case 11, in which a transport apparatus 20 that transports a medium M along a transport path and a printing unit 30 that performs printing onto the medium M being transported are provided. In FIG. 1, let the direction perpendicular to the paper sheet of the figure be indicated by X, meaning a width direction X of the medium M. In this case, the transport path is formed to transport the medium M in a direction intersecting the width direction X of the medium M, preferably in the direction perpendicular to the width direction X.

In the following explanations, a direction in which the medium M is transported along the transport path is indicated by Y, denoting a transport direction Y; the vertical direction is indicated by Z, denoting a vertical direction Z. Here, the vertical direction Z intersects (is perpendicular to) the width direction X.

The printing unit 30 includes a print head 31, which is a line head that can simultaneously eject ink, one example of a printing material, almost entirely across the width of the medium M. The print head 31 has nozzles 32 disposed across the width (see FIG. 2); ink is ejected from these nozzles onto the medium M. The ink adheres to the medium M to form images thereon.

The transport apparatus 20 includes an ejection mechanism section 40 that ejects the printed medium M to outside the case 11 and a feed mechanism section 50 that feeds the medium M to be printed along the transport path.

The ejection mechanism section 40 has a plurality of ejection roller pairs 41 disposed along the transport path. The medium M, which is transported by the ejection mechanism section 40, is ejected to outside the case 11 from a medium ejection port 42 formed in the case 11. That is, the medium ejection port 42 is a downstream end of the transport path, or the lowermost transport path. The medium M, after being ejected from the medium ejection port 42, is stacked on a stand 43, as indicated by the dash-double-dot line in FIG. 1.

The feed mechanism section 50 has a first medium supply section 51, a second medium supply section 52, a third medium supply section 53, and an electrostatic transport section 70. The electrostatic transport section 70 is disposed immediately below the printing unit 30 in the figure. This means that ink is ejected from the print head 31 onto the medium M being transported by the electrostatic transport section 70.

A cover 12 (that can be opened/closed) is provided on one side of the case 11 (on the right side in FIG. 1). Opening the cover 12 exposes an insertion port 13. The first medium supply section 51 includes a first feed roller pair 54 that pinches and holds the medium M, which has been inserted from the exposed insertion port 13 into the case 11. The two rollers of the first feed roller pair 54 are rotated to feed the medium M toward the electrostatic transport section 70.

Additionally, a paper cassette 55 where mediums M to be printed are set, or stacked, is provided on the bottom of the case 11 in FIG. 1. The second medium supply section 52 feeds each medium M from the paper cassette 55. This means that the second medium supply section 52 includes a pickup roller 56 that feeds out, from the paper cassette 55, the topmost medium M in the paper cassette 55, a separation roller pair 57 that inhibits a plurality of mediums M from being transported on top of each other, and a second feed roller pair 58 that pinches and holds one sheet of medium M which has passed through the separation roller pair 57. The two rollers of the second feed roller pair 58 are rotated to feed the medium M toward the electrostatic transport section 70.

The third medium supply section 53 is a supply section that, when two-sided printing is performed in which the medium M is printed on both sides of the sheet, guides the medium M, which has been printed on one side of the sheet, again toward the electrostatic transport section 70. This means that the transport path of the medium M in this embodiment contains a first transport path 61 and a second transport path 62, which is disposed downstream from the electrostatic transport section 70 in the transport direction Y and branches from the first transport path 61. The third medium supply section 53 is provided with a branch mechanism 63, being disposed downstream from the electrostatic transport section 70 in the transport direction Y, that switches the transport path of the medium M between the first transport path 61 and the second transport path 62 and a second-transport-path roller pair 64, being disposed on the second transport path 62, that can be rotated in both forward and reverse directions.

For two-sided printing, the medium M, which has been printed on one side of the sheet, is guided by the branch mechanism 63 from the electrostatic transport section 70 toward the second transport path 62. In this case, the rollers of the second-transport-path roller pair 64 are rotated in the forward direction to transport the medium M downstream in the transport direction Y. When the back edge of the medium M is guided toward the second transport path 62, the rollers of the second-transport-path roller pair 64 are rotated in the reverse direction to transport the medium M in the reverse direction. Then, the medium M is guided toward a reverse supply path 65 located above the printing unit 30 in FIG. 1.

A plurality of reverse transport roller pairs 66 are disposed on the reverse supply path 65. The rollers of these roller pairs are rotated to feed the medium M along the reverse supply path 65. After this, the medium M joins into the first transport path 61 upstream from the electrostatic transport section 70 in the transport direction Y. Subsequently, the medium M is again guided toward the electrostatic transport section 70.

When the medium M is again guided toward the electrostatic transport section 70 as described above, the sheet surface on which printing has been completed makes contact with the electrostatic transport section 70; the sheet surface on which printing is not performed faces the print head 31. Of the two sides of the medium M, the sheet surface which makes contact with the electrostatic transport section 70 is called the contact surface Ma; the surface opposite to the contact surface Ma is called the printing surface Mb.

More precisely, in the printing apparatus 10 in this embodiment, a reverse mechanism is configured to reverse and invert the medium M and guide the medium M toward the electrostatic transport section 70. In this reverse mechanism, after printing is finished on the first surface of both sides of the medium M, that is, on the printing surface Mb, the third medium supply section 53 serves to invert the sheet, that is, cause a state where the first surface becomes the contact surface Ma and the second surface becomes the printing surface Mb.

Next, referring to FIG. 2 and FIG. 3, the structure of the electrostatic transport section 70 and the peripheral members will be described.

Figure 2:
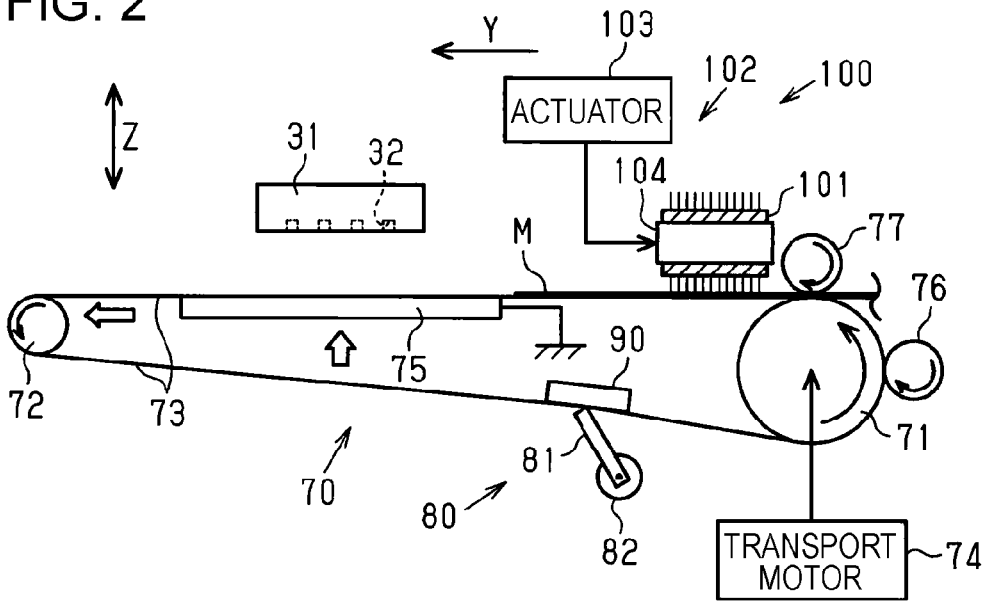
FIG. 2 is a side view schematically illustrating an electrostatic transport section and peripheral components in the printing apparatus.
Figure 3:
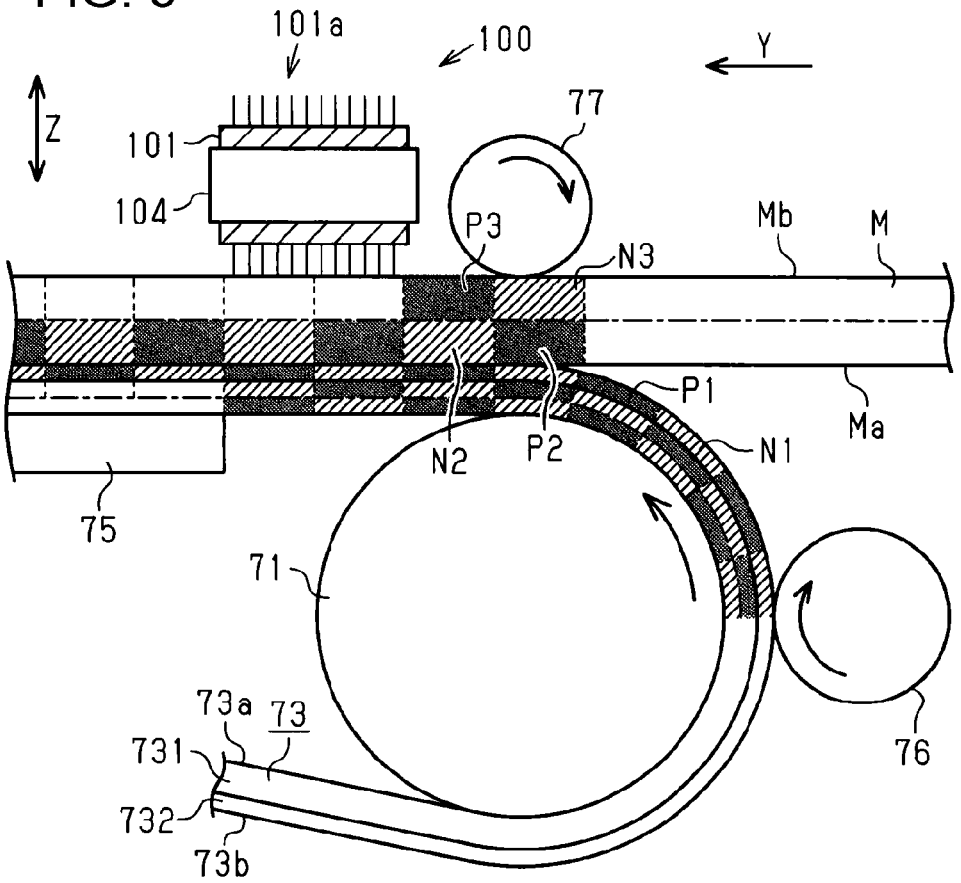
FIG. 3 is a side view schematically illustrating how electric charge is applied to a transport belt.

As illustrated in FIG. 2 and FIG. 3, the electrostatic transport section 70 is provided with a transport-related driving roller 71 that is disposed upstream (i.e., on the right side in the figure) from the print head 31 in the transport direction Y and a transport-related driven roller 72 that is disposed downstream (i.e., on the left side in the figure) from the print head 31 in the transport direction Y. In the transport-related driving roller 71 and the transport-related driven roller 72, the width direction X is the direction of the axis of rotation. A transport belt 73, an endless (loop) belt, is looped over these two rollers 71 and 72. In regard to this point, in this embodiment, the transport-related driving roller 71 corresponds to one example of a first rotator; the transport-related driven roller 72 corresponds to one example of a second rotator.

As indicated by the arrow in FIG. 2, the transport-related driven roller 72 is biased in the direction away from the transport-related driving roller 71 (to the left in the figure). When a transport motor 74 runs to drive the transport-related driving roller 71, in response to this, the transport belt 73 rotates to transport the medium M downstream in the transport direction Y. At this time, the outer surface of the transport belt 73 makes contact with the contact surface Ma of the medium M, serving as a support surface that supports the medium M. Furthermore, in this embodiment, the transport belt 73 aligns its center in the width direction X with the center of the medium M to be transported.

In the following explanations, the surface of the transport belt 73 that makes contact with the transport-related driving roller 71 and the transport-related driven roller 72 is the inner surface 73*a*; the surface of the transport belt 73 that makes contact with the contact surface of the medium M to support the medium M is the outer surface 73*b*.

A backup plate 75 that supports the medium M via the transport belt 73 is provided directly below the print head 31. The backup plate 75 is made of metal and grounded. In addition, the backup plate 75 makes contact with the inner surface 73*a* of the transport belt 73, which is opposite to the support surface of the transport belt 73, and at the same time biases the transport belt 73 toward the print head 31 side.

A wiping section 80 that wipes the outer surface 73*b* of the transport belt 73 is provided vertically below the transport belt 73. The wiping section 80 includes a cleaning blade 81 that makes contact with the outer surface 73*b* of the transport belt 73 and a blade support section 82 that supports the cleaning blade 81.

The cleaning blade 81 is made of an elastic material, such as rubber or the like, and has substantially the same length in the width direction X as the transport belt 73. The blade support section 82 supports the cleaning blade 81 so that the cleaning blade 81 can bias the outer surface 73*b* of the transport belt 73 toward the inner surface 73*a* of the transport belt 73, which is looped over the transport-related driving roller 71 and the transport-related driven roller 72. The wiping section 80 wipes the outer surface 73*b* of the transport belt 73 by sliding in contact with the outer surface 73*b* of the transport belt 73 in response to rotation of the transport belt 73.

The blade support section 82 may be configured so that the support angle of the cleaning blade 81 can be changed. According to this configuration, the pressing force of the cleaning blade 81 against the transport belt 73 can be changed to change the wiping performance of the transport belt 73.

A hold section 90 that holds, in conjunction with the wiping section 80, the transport belt 73 is provided at a position facing the wiping section 80 across the transport belt 73. The hold section 90 is provided across the inner surface 73*a*, in contact with the inner surface 73*a* of the transport belt 73 biased by the wiping section 80. In this case, the hold section 90 is formed as a substantially rectangular plate, with the longer side denoting the width direction X and the shorter side denoting the direction of rotation of the transport belt 73. When the wiping section 80 is wiping the transport belt 73, the transport belt 73 is held across the width between the hold section 90 and the wiping section 80.

An electrifying roller 76 is provided, as an example of an electrifying section, upstream (on the right side in the figure) from the transport-related driving roller 71 in the transport direction Y. The electrifying roller 76 is in contact with the outer surface 73*b* of the transport belt 73. When rotation of the transport-related driving roller 71 is transmitted via the transport belt 73 to the electrifying roller 76, the electrifying roller 76 is rotationally driven in response to the transport-related driving roller 71. In this case, the electrifying roller 76 applies electric charge to the portions on the outer surface 73*b* of the transport belt 73 which are in contact with the electrifying roller 76. That is, the transport belt 73 is electrified by contact with the electrifying roller 76. In the printing apparatus 10 in this embodiment, the electrifying roller 76 alternately applies a positive electric charge and a negative electric charge to the transport belt 73 in contact.

A support roller 77 that presses, against the transport belt 73, the medium M which has been fed into the electrostatic transport section 70 is provided upstream (on the right side in the figure) from the print head 31 in the transport direction Y. Specifically, the support roller 77 presses the medium M against the transport belt 73 being electrically charged. The support roller 77 is made of a conductive material, for example, metal, and is grounded. When rotation of the transport-related driving roller 71 is transmitted via the transport belt 73 to the support roller 77, the support roller 77 is rotationally driven in response to the transport-related driving roller 71.

Additionally, a static eliminator 100 is provided between the support roller 77 and the print head 31 in the transport direction Y. In other words, the static eliminator 100, or a static eliminating section 101, is disposed upstream from the print head 31 in the transport direction Y. As described above, the wiping section 80 is disposed at a side opposite the print head 31, as viewed from the static eliminator 100 (the static eliminating section 101) in the direction of rotation of the transport belt 73; the electrifying roller 76 is provided between the wiping section 80 and the static eliminating section 101 in the direction of rotation of the transport belt 73.

The static eliminator 100 includes the static eliminating section 101 that eliminates electric charge and an actuator-related section 102 that brings the static eliminating section 101 into operation to change the region on the static eliminating section 101 that makes contact with the medium M and the transport belt 73. When the static eliminating section 101 makes contact with the printing surface Mb of the medium M being transported by the transport belt 73, the static eliminating section 101 eliminates electric charge from the printing surface Mb.

Next, referring to FIG. 3, the transport belt 73 will be described.

As illustrated in FIG. 3, the transport belt 73 has a dielectric layer 731, being formed as a loop, and a conductive layer 732, being formed as a loop on the outer side of the dielectric layer 731. The conductive layer 732 is configured to have a smaller electric resistance than the dielectric layer 731. The outer surface of the conductive layer 732 is the outer surface 73*b* of the transport belt 73; the inner surface of the dielectric layer 731 is the inner surface 73*a* of the transport belt 73.

When the transport belt 73 rotates in response to rotation of the transport-related driving roller 71, the electrifying roller 76 is rotationally driven. A positive portion P1, that is, a portion to be charged positively and a negative portion N1, that is, a portion to be charged negatively are alternately formed on the outer surface 73*b* of the transport belt 73, that is, on the conductive layer 732. When electric charge is applied to the conductive layer 732 in this manner, polarization occurs in the dielectric layer 731 firmly stuck to the conductive layer 732.

Such polarization in the dielectric layer 731 causes electric charge in the conductive layer 732 to be neutralized by electric charge in the dielectric layer 731. This neutralization may reduce the amount of electric charge in the conductive layer 732. In this case, the electrostatic adsorption force of the transport belt 73 with respect to the medium M may be reduced.

In the printing apparatus 10 in this embodiment, as described above, the inner surface 73*a* of the transport belt 73, that is, the dielectric layer 731 makes contact with the backup plate 75, which is grounded. For this reason, electric charge in the dielectric layer 731 is eliminated by the backup plate 75. Thus, on the transport belt 73, electric charge in the conductive layer 732 cannot easily be neutralized by electric charge in the dielectric layer 731, and as such, the amount of electric charge in the conductive layer 732 is less likely to decrease.

When the medium M is pressed against the outer surface 73*b* of the transport belt 73 by the support roller 77, the medium M makes close contact with the transport belt 73, causing polarization in the medium M. In other words, a portion on the contact surface Ma of the medium M (the bottom surface in the figure), facing the positive portion P1 of the transport belt 73, is a negative portion N2 to be charged negatively, whereas a portion on the contact surface Ma of the medium M, facing the negative portion N1 of the transport belt 73, is a positive portion P2 to be charged positively. Also on the contact surface Ma of the medium M, the positive portion P2 and the negative portion N2 are alternately formed.

Again, on the printing surface Mb of the medium M which is opposite to the contact surface Ma, a positive portion P3 to be charged positively and a negative portion N3 to be charged negatively are also alternately formed. Electric charge on the printing surface Mb is eliminated by the static eliminating section 101 making contact with the printing surface Mb. Eliminating electric charge on the printing surface Mb suppresses a decrease in electric charge on the contact surface Ma and thus suppresses a reduction in the electrostatic adsorption force of the transport belt 73 with respect to the medium M.

In this way, in this embodiment, the transport belt 73 electrostatically adsorbs the medium M on the outer surface 73*b*, rotates in response to driving of the transport-related driving roller 71, and transports the medium M in the transport direction Y. In printing, the print head 31 ejects ink from the nozzles 32 onto the printing surface Mb of the medium M electrostatically adsorbed onto the transport belt 73 with stabilized positioning.

Next, referring to FIG. 4 and FIG. 5, the static eliminator 100 will be described.

Figure 4:
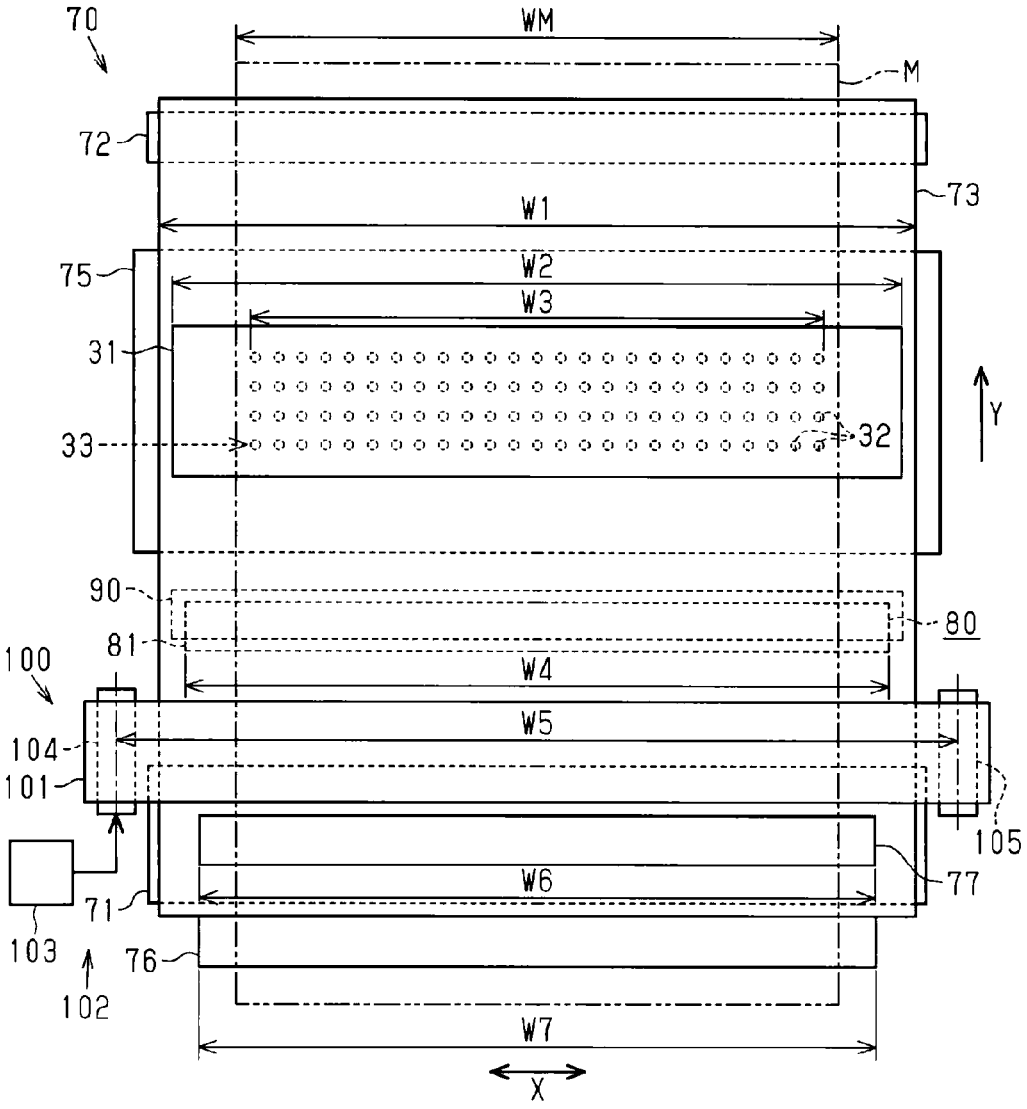
FIG. 4 is a plan view schematically illustrating the electrostatic transport section and the peripheral components in the printing apparatus.
Figure 5:
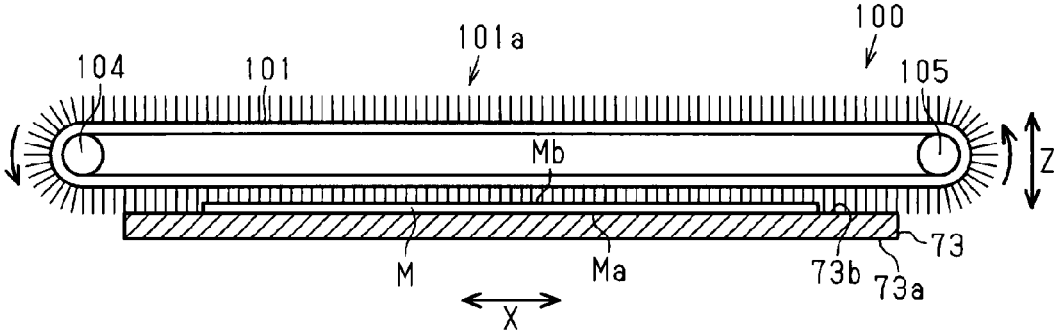
FIG. 5 is a front view illustrating the general structure of a static eliminator.

As illustrated in FIG. 4 and FIG. 5, the actuator-related section 102 of the static eliminator 100 includes an actuator 103, an actuator-related driving roller 104 coupled to and driven by the actuator 103, and an actuator-related driven roller 105. The actuator-related driving roller 104 is disposed to extend beyond one side of the transport belt 73 (i.e., to the left away from the transport belt 73 in FIG. 4) in the width direction X of the medium M; the actuator-related driven roller 105 is disposed to extend beyond the other side of the transport belt 73 (i.e., to the right away from the transport belt 73 in FIG. 4) in the width direction X of the medium M. The transport belt 73 is thus disposed between the rollers 104 and 105 in the width direction X.

The static eliminating section 101 of the static eliminator 100 has a brush 101*a* protruding externally from an endless belt. The static eliminating section 101 is formed as a loop and the brush 101*a* is pressed against the printing surface Mb of the medium M to eliminate electric charge from the printing surface Mb. The material of the brush 101*a* may be a metal material, such as stainless steel, or may be a resin material.

The static eliminating section 101 is looped over the actuator-related driving roller 104 and the actuator-related driven roller 105. One end of the static eliminating section 101 in the width direction X of the medium M is extending beyond one end of the transport belt 73 in the width direction X; the other end of the static eliminating section 101 in the width direction X is extending beyond the other end of the transport belt 73 in the width direction X.

When the actuator 103 drives the actuator-related driving roller 104 to rotate in the direction indicated by the arrow in FIG. 5, the static eliminating section 101 runs in the direction indicated by the arrow in FIG. 4. The static eliminating section 101 running in this manner can change the region on the static eliminating section 101 that makes contact with the medium M electrostatically adsorbed onto the transport belt 73.

The static eliminating section 101 is configured to make contact with the medium M electrostatically adsorbed onto the transport belt 73 across the entire area in the width direction X. The static eliminating section 101 is thus disposed so as to extend across the printing surface Mb of the medium M to be transported and in a defined direction of which the main component is the width direction X of the medium M.

Incidentally, bringing the static eliminating section 101 into contact with the medium M causes a foreign substance, such as paper powder, to adhere to the static eliminating section 101 or causes the static eliminating section 101 to increasingly deteriorate. When a large amount of a foreign substance has adhered to the static eliminating section 101 or the static eliminating section 101 has severely deteriorated, the static eliminating section 101 may eliminate electric charge from the medium M at a lower efficiency. So, in the printing apparatus 10 in this embodiment, the region on the static eliminating section 101 that makes contact with the medium M is appropriately changed.

Next, referring to FIG. 4, each component in the printing apparatus 10 and length thereof in the width direction X will be described.

As illustrated in FIG. 4, let the lengths in the width direction X be indicated as follows:

length of transport belt 73 indicated by width W1, length of print head 31 indicated by width W2, length of nozzle row 33 composed of a plurality of nozzles 32 arranged in the width direction X in print head 31 indicated by width W3, length of wiping section 80 (cleaning blade 81) indicated by width W4, length of static eliminating section 101 indicated by width W5, length of support roller 77 indicated by width W6, length of electrifying roller 76 indicated by width W7, and length of medium M longest in the width direction X among mediums M printable by printing apparatus 10 indicated by width WM.

Here, the width of the wiping section 80 represents the effective length of the wiping section 80 (the cleaning blade 81) at which the transport belt 73 can be wiped. Similarly, the width of the static eliminating section 101 represents the effective length of the static eliminating section 101 at which the transport belt 73 can be wiped; in this embodiment, this width corresponds to a distance between the axis of the actuator-related driving roller 104 and the axis of the actuator-related driven roller 105. The width of a nozzle row 33 corresponds to a printing width which is printable by the print head 31.

In this embodiment, the following relations are valid:

(width $W3$ of nozzle row 33)≤(width $WM$ of medium $M$)<(width $W6$ of support roller 77)=(width $W7$ of electrifying roller 76)≤(width $W4$ of wiping section 80)≤(width $W2$ of print head 31)≤(width $W1$ of transport belt 73)≤(width $W5$ of static eliminating section 101).

More precisely, the following relations are valid in this embodiment:

(width $W3$ of nozzle row 33)<(width $WM$ of medium $M$)<(width $W6$ of support roller 77)=(width $W7$ of electrifying roller 76)<(width $W4$ of wiping section 80)<(width $W2$ of print head 31)<(width $W1$ of transport belt 73)<(width $W5$ of static eliminating section 101).

In other words, the width W5 of the static eliminating section 101 is larger than the width W4 of the wiping section 80 and is larger than the width W2 of the print head 31. Additionally, the width W2 of the print head 31 is larger than the width W4 of the wiping section 80.

In this embodiment, the brush 101*a* of the static eliminating section 101 makes contact not only with the medium M electrostatically adsorbed onto the transport belt 73 but also with the outer surface 73*b* of the transport belt 73 on both ends in the width direction X because the width W5 of the static eliminating section 101 is larger than the width WM of the medium M.

Each of the widths W1, W2, W3, W4, W5, W6, and W7 in this embodiment denotes a length in the width direction X when each component is projected in the transport direction Y. One example includes a case where the nozzle row 33 is formed at an angle to the direction of width X or to the direction of transport Y. In this case, the width W3 is not the length of the nozzle row 33 in a direction in which the nozzle row 33 is formed, but the length in the width direction X when the nozzle row 33 is projected in the transport direction Y. All other configurations are interpreted similarly with respect to the case of the nozzle row 33.

Next, referring to FIGS. 6 to 9, operations of the printing apparatus 10 in this embodiment will be described. FIGS. 6 to 9 are views illustrating the wiping section 80, the electrifying roller 76, the static eliminating section 101, and the print head 31 with their surrounding configurations, with each component viewed in the direction of rotation of the transport belt 73.

For printing onto the medium M in the printing apparatus 10, the transport motor 74 first drives the transport-related driving roller 71 to rotate, causing the transport belt 73 to rotate. Next, the electrifying roller 76 electrifies the transport belt 73 and at same time the support roller 77 presses the medium M against the electrified transport belt 73 to electrify the medium M. Subsequently, the backup plate 75 eliminates electric charge in the dielectric layer 731 of the transport belt 73, whereas the static eliminating section 101 eliminates electric charge on the printing surface Mb of the medium M. The medium M is thus transported with the reduction in the electrostatic adsorption force of the transport belt 73 with respect to medium M being suppressed.

After that, when the medium M electrostatically adsorbed onto the transport belt 73 is transported to a position facing the print head 31, ink is ejected from the print head 31 onto the printing surface Mb of the medium M to be printed. The transport belt 73, after having transported the printed medium M, is wound around the transport-related driven roller 72 and is then wiped at the wiping section 80 where adhering material S, including medium pieces and paper, which have adhered to the outer surface 73*b* of the transport belt 73 during printing or transport of the medium M are removed. Finally, the transport belt 73 of which the outer surface 73*b* has been wiped by the wiping section 80 is wound around the transport-related driving roller 71 and is electrified again to transport the medium M in the transport direction Y.

Figure 6:
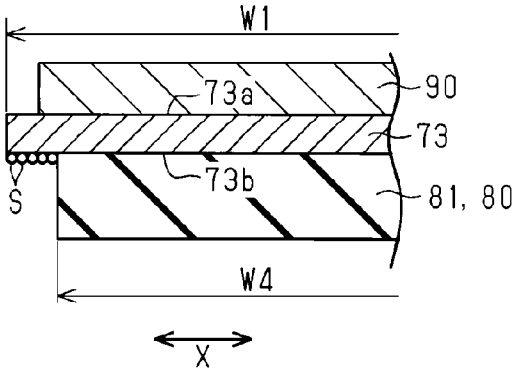
FIG. 6 is an operational view illustrating the positional relationship between a transport belt and a wiping section during printing.

As illustrated in FIG. 6, in this embodiment, the width W1 of the transport belt 73 is larger than the width W4 of the wiping section 80. Thus, of the adhering material S to the outer surface 73*b* of the transport belt 73, the adhering material S within the range that the wiping section 80 can wipe are removed, but the adhering material S out of the range that the wiping section 80 can wipe remain unremoved.

Figure 7:
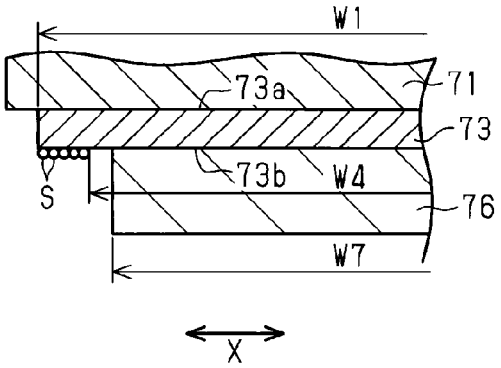
FIG. 7 is an operational view illustrating the positional relationship between the transport belt and an electrifying roller during printing.

As illustrated in FIG. 7, the width W7 of the electrifying roller 76 is smaller than the width W4 of the wiping section 80. Thus, of the outer surface 73*b* of the transport belt 73, the area that the electrifying roller 76 makes contact with is an area that has been wiped by the wiping section 80. That is, this configuration inhibits the electrifying roller 76 from electrifying the transport belt 73 to which the adhering material S have adhered. Thus, the amount of electric charge applied to the transport belt 73 is inhibited from decreasing and fluctuations are suppressed in the amount of applied electric charge in the direction of rotation of the transport belt 73 and in the width direction X.

Figure 8:
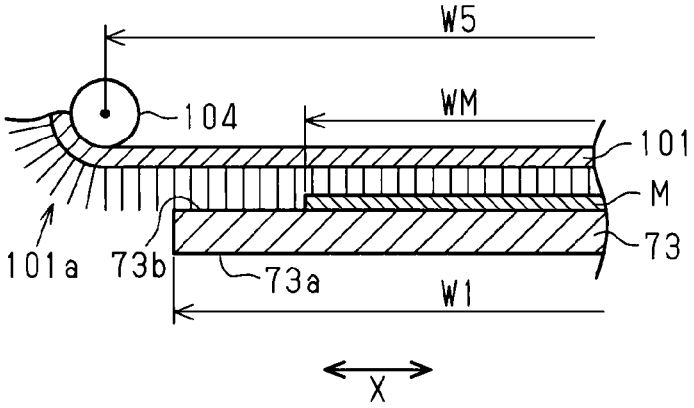
FIG. 8 is an operational view illustrating the positional relationship between the transport belt and a static eliminating section during printing.

As illustrated in FIG. 8, the width W5 of the static eliminating section 101 is larger than the width W1 of the transport belt 73 and is thus larger than the width W4 of the wiping section 80. The adhering material S to the transport belt 73 that has not been wiped by the wiping section 80 are thus eliminated by the static eliminating section 101 that wipes the transport belt 73. In the area in which the static eliminating section 101 and the transport belt 73 face each other, the medium M is electrostatically adsorbed onto the transport belt 73. The area on the transport belt 73 which the static eliminating section 101 wipes is thus an area in which the transport belt 73 has not adsorbed the medium M thereon. In this respect, the static eliminating section 101 in this embodiment wipes the outer surface 73*b* of the transport belt 73 while eliminating electric charge from the printing surface Mb of the medium M adsorbed onto the transport belt 73.

Figure 9:
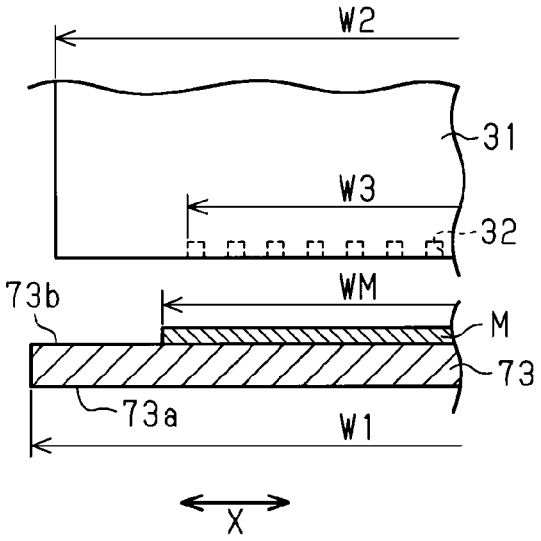
FIG. 9 is an operational view illustrating the positional relationship between the transport belt and a print head during printing.

As illustrated in FIG. 9, the width W2 of the print head 31 is smaller than the width W1 of the transport belt 73 and is thus smaller than the width W5 of the static eliminating section 101. Thus, of the outer surface 73*b* of the transport belt 73, the area that faces the print head 31 is an area that has been wiped by the static eliminating section 101. The adhering material S to this area neither adhere to the print head 31 nor make contact with the print head 31. As a result, the printing apparatus 10 can suppress a reduction in the ink ejection performance of the print head 31 and a reduction in the printing quality of the apparatus.

The above configurations have the following advantages:

(1) The adhering material S to the outer surface 73*b* of the transport belt 73 are removed by the wiping section 80 in response to rotation of the transport belt 73. The adhering material S on the outer surface 73*b* of the transport belt 73 that have not been removed by the wiping section 80 are removed by the static eliminating section 101, which is longer than the wiping section 80 in the width direction X. That is, the adhering material S that the wiping section 80 has not removed are removed by the static eliminating section 101.

According to this configuration, two structures, the static eliminating section 101 and the wiping section 80, used for wiping the outer surface 73*b* of the transport belt 73 can remove the adhering material S to the transport belt 73. Since one of the two structures that are used to wipe the outer surface 73*b* of the transport belt 73 is the static eliminating section 101 that is used to eliminate electric charge from the printing surface Mb of the medium M, this configuration can minimize complexity around the transport belt 73, compared to cases where a separate structure that eliminates electric charge from the printing surface Mb of the medium M is provided in addition to two structures that are used to merely wipe the outer surface 73*b* of the transport belt 73.

(2) Since the static eliminating section 101 has the brush 101*a*, the adhering material S to the transport belt 73 can be removed easily.

(3) Providing the electrifying roller 76 that electrifies the transport belt 73 increases the adsorption force of the transport belt 73 with respect to the medium M. Since the width W7 of the electrifying roller 76 is less than the width W4 of the wiping section 80, the area that the electrifying roller 76 makes contact with in electrifying the transport belt 73 is an area from which the adhering material S have been removed by the wiping section 80. This configuration can thus electrify the transport belt 73 more efficiently and can inhibit the adhering material S to the transport belt 73 from adhering to the electrifying roller 76.

(4) Since the width W5 of the static eliminating section 101 is larger than the width W2 of the print head 31, the area on the transport belt 73, facing the print head 31, is an area that has been wiped by the static eliminating section 101. The adhering material S to the transport belt 73 neither make contact with the print head 31 nor adhere to the print head 31. As a result, this configuration can suppress a reduction in the printing quality of the printing apparatus 10.

(5) Slack on the transport belt 73 looped over the transport-related driving roller 71 and the transport-related driven roller 72 may cause the transport belt 73 to rotate irregularly, leading to a reduction in the transport accuracy of the medium M. Since, in this embodiment, the outer surface 73*b* of the transport belt 73 is biased toward the inner surface 73*a*, tension can be applied to the transport belt 73 so as not to become loose. This configuration can avoid slack on the transport belt 73 and can suppress a reduction in the transport accuracy of the medium M. In other words, there is no need for a configuration in which tension is applied to the transport belt 73.

(6) When the wiping section 80 is wiping the outer surface 73*b* of the transport belt 73, the transport belt 73 may be displaced away from the wiping section 80. This displacement may reduce the pressing force of the wiping section 80 against the transport belt 73. In this state, the outer surface 73*b* of the transport belt 73 cannot be wiped normally. In contrast, according to this embodiment, when the wiping section 80 is wiping the outer surface 73*b* of the transport belt 73, the hold section 90 makes contact with the inner surface 73*a* of the transport belt 73; the transport belt 73 is held between the wiping section 80 and the hold section 90. As a result, the transport belt 73 is inhibited from being displaced away from the wiping section 80. Thus, when the wiping section 80 is wiping the transport belt 73, the adhering material S to the transport belt 73 can be removed easily.

The above-mentioned embodiments may be changed as described below:

The width W5 of the static eliminating section 101 may be less than the width W2 of the print head 31. In this case, the width W5 of the static eliminating section 101 is preferably equal to or greater than the width W3 of the nozzle row 33. This configuration may cause the adhering material S to the transport belt 73 to adhere to the print head 31, but can reduce the possibility of the adhering material S adhering to the nozzles 32 of the print head 31.

The wiping section 80 (the cleaning blade 81) may not bias the outer surface 73*b* of the transport belt 73 toward the inner surface 73*a* of the transport belt 73. For example, the wiping section 80 may only make contact with the outer surface 73*b* of the transport belt 73.

The static eliminating section 101 may be made of a metal film forming an array of strips; bringing the metal film into contact with the printing surface Mb of the medium M removes electric charge from the printing surface Mb.

The static eliminating section 101 may be a roller brush having a brush on the periphery of a roller with the width direction X being the direction of an axis of rotation. In this case, the roller brush may rotate or may not rotate in response to transport of the medium M.

The wiping section 80 may wipe the outer surface 73*b* of the transport belt 73 by pressing a cloth wiper formed of a fabric or the like against the outer surface 73*b* of the transport belt 73. In this case, the transport section may have a press roller that presses the cloth wiper against the outer surface 73*b* of the transport belt 73.

The printing unit 30 may be a unit that ejects ink from the print head 31 onto the printing surface Mb of the medium M while moving the print head 31 in a predetermined scan direction. In this case, the width W5 of the static eliminating section 101 is preferably equal to or greater than the width W1 of the transport belt 73.

The backup plate 75 may be made of any conductive material other than a metal material.

The backup plate 75 may not be grounded if the medium M can be electrostatically adsorbed onto the transport belt 73 without eliminating electric charge in the dielectric layer 731 of the transport belt 73. In this case, the backup plate 75 may be made of a non-conductive material.

The backup plate 75 may not bias the transport belt 73 toward the print head 31 side if adequate tension is maintained on the transport belt 73 with no tension applied by the backup plate 75.

The medium M onto which the printing apparatus 10 performs printing, if it can be electrostatically adsorbed onto the transport belt 73, may be a medium other than paper.

The hold section 90 may not be provided. The electrifying roller 76 as one example of the electrifying section may not be provided.

In the above-mentioned embodiments, a recording material used for printing may be a fluid other than ink (a fluid includes liquid, a liquid-like material obtained by dispersing or mixing particles of a functional material in a liquid, a fluid-like material, such as gel, and a solid which can be made to flow and ejected as fluid). For example, the apparatus may be configured to perform recording by ejecting a liquid-like material containing a material, such as an electrode material or a colorant (a pixel material), to be used for manufacturing a liquid crystal display, an electroluminescent (EL) display, or a surface emitting display in a form of a dispersion or solution.

In the above-mentioned embodiments, the printing apparatus 10 may be a fluid-like material ejecting apparatus that ejects a fluid-like material, such as gel (e.g., physical gel) or the like, or may be a granular material ejecting apparatus (e.g., a toner jet recording apparatus) that ejects a solid, for example, a powder (a granular material), such as toner or the like.

In the above-mentioned embodiments, the printing apparatus 10, not limited to a printer that performs recording by ejecting fluid, such as ink or the like, may be, for example, a non-impact printer, such as a laser printer, an LED printer, a thermal transfer printer (including a sublimation printer), or may be an impact printer, such as a dot impact printer or the like.

The entire disclosure of Japanese Patent Application No. 2015-230325, filed Nov. 26, 2015 is expressly incorporated by reference herein.

What is claimed is:

1. A printing apparatus comprising:

an endless transport belt configured to electrostatically adsorb a medium on an outer surface of the transport belt and to rotate to transport the medium in a transport direction;

a print head configured to perform printing onto a printing surface of the medium electrostatically adsorbed onto the transport belt;

a static eliminating section configured to make contact with the outer surface of the transport belt and the printing surface of the medium electrostatically adsorbed on the outer surface of the transport belt and to eliminate electric charge from the printing surface of the medium, the static eliminating section being disposed upstream from the print head in the transport direction; and a wiping section configured to wipe the outer surface of the transport belt, the wiping section being disposed at a side opposite the print head, as viewed from the static eliminating section in a direction of rotation of the transport belt;

an electrifying section that electrifies the transport belt, wherein the electrifying section is disposed downstream of the wiping section in the transport direction and upstream of the static eliminating section in the transport direction; and wherein the static eliminating section is longer than the wiping section in a width direction intersecting the transport direction.

2. The printing apparatus according to claim 1, wherein the static eliminating section has a brush that makes contact with the outer surface of the transport belt and the printing surface of the medium.

3. The printing apparatus according to claim 1, wherein the static eliminating section is equal to or longer than the print head in the width direction.

4. The printing apparatus according to claim 1, further comprising:

a first rotator and a second rotator with the width direction being a direction of an axis of rotation, the first rotator and the second rotator being provided at different positions in the transport direction, wherein the transport belt is looped over the first rotator and the second rotator; the wiping section biases, toward an inner surface of the transport belt, the outer surface of the transport belt looped over the first rotator and the second rotator.

5. The printing apparatus according to claim 4, further comprising:

a hold section that holds, in conjunction with the wiping section, the transport belt across the width by making contact with the inner surface of the transport belt when the wiping section is wiping the outer surface of the transport belt.

* * * * *